US006267187B1

(12) United States Patent
Püttmann et al.

(10) Patent No.: US 6,267,187 B1
(45) Date of Patent: Jul. 31, 2001

(54) BORING APPARATUS WITH COUPLING FOR RAPID CONNECTION OF DRILL STRING SEGMENTS

(75) Inventors: Franz-Josef Püttmann; Gerhard Balve, both of Lennestadt (DE)

(73) Assignee: Tracto-Technik Paul Schmidt Spezialmaschinen, Lennestadt (DE)

( * ) Notice: Subject to any disclaimer, the term of this patent is extended or adjusted under 35 U.S.C. 154(b) by 0 days.

(21) Appl. No.: 09/097,974

(22) Filed: Jun. 16, 1998

(30) Foreign Application Priority Data

Jun. 17, 1997 (DE) ..... 197 25 628

(51) Int. Cl.[7] ..... E21B 7/20
(52) U.S. Cl. ..... 175/122; 175/113; 173/148
(58) Field of Search ..... 175/61, 62, 122; 173/152, 148; 285/39; 405/154, 156, 184

(56) References Cited

U.S. PATENT DOCUMENTS

| | | | | |
|---|---|---|---|---|
| 3,463,247 | * | 8/1969 | Klein | 285/39 |
| 3,490,546 | * | 1/1970 | Hattrup et al. | 173/28 |
| 3,744,577 | * | 7/1973 | Williams | 173/163 |
| 4,507,019 | | 3/1985 | Thompson | 405/154 |
| 4,553,612 | * | 11/1985 | Durham | 175/122 |
| 4,953,638 | * | 9/1990 | Dunn | 175/62 |
| 5,288,173 | | 2/1994 | Jenne et al. | 405/184 |
| 5,431,234 | | 7/1995 | Klemm | 173/184 |
| 5,555,947 | * | 9/1996 | Bunker et al. | 175/62 |
| B1 4,507,019 | | 12/1987 | Thompson | 405/154 |

FOREIGN PATENT DOCUMENTS

| | | |
|---|---|---|
| 1025807 | 9/1955 | (DE) . |
| 2704154 | 8/1978 | (DE) . |
| 4113422 | 10/1992 | (DE) . |

* cited by examiner

*Primary Examiner*—Frank Tsay
(74) *Attorney, Agent, or Firm*—Merchant & Gould P.C.

(57) ABSTRACT

In apparatus for producing and expanding earth boreholes and for destroying and replacing underground pipelines or for driving in pipes, a feed drive and a rotary drive having a plug-in coupling comprising a chuck and a locking portion at the end of a string is located in a frame. The string comprises a plurality of sections or lengths having an internal screw thread at one end and an external screw thread on the locking portion at the other end, which at the same time is provided with a key face to hold fast said string section while it is screwed together with the next following string section.

18 Claims, 5 Drawing Sheets

BORING APPARATUS WITH COUPLING FOR RAPID CONNECTION OF DRILL STRING SEGMENTS

FIELD OF THE INVENTION

The invention relates to apparatus for producing and expanding earth boreholes and for destroying and replacing underground pipelines or for driving in pipes.

BACKGROUND AND PRIOR ART

Apparatus of this kind is known and has often proved its worth in practice. However, it requires a considerable amount of space and, for example in the case of horizontal boring, needs a correspondingly large excavation or launch pit.

A boring apparatus for destructive replacement of an underground pipeline is known, for example, from U.S. Pat. No. 4,507,019. This apparatus comprises a frame with an adjustable mounting for two feed cylinders connected to a sliding carriage. Mounted on the carriage is a rotary drive of which the horizontal shaft is provided with an external screw thread and can be screwed on to the internal screw thread at the rearward end of a drill string made up of a number of sections. As a result of the length of the frame the known apparatus requires a large excavation or launch pit.

Added to this is the fact that when lengthening the drill string the new section of the string has to be aligned with the external thread of the drive shaft and also with the internal thread at the rearward end of the drill string or of the last section thereof, and then screwed first of all on to the external thread of the drive shaft and then into the internal thread of the drill string. This requires a double screwing operation for each section of the string and therefore is not only unnecessarily time-consuming but also increases the space required, since the distance between the drive shaft on the one hand and the rearward end of the drill string on the other hand must be greater than the length of a string section.

A further disadvantage of the known boring apparatus is that before the addition of a new section to the string the drive shaft must be unscrewed from the internal thread at the end of the drill string while the drill string is held fast by means of expensive auxiliary units to enable the screw thread of the drive shaft to be unscrewed from the end of the drill string. For this purpose German Offenlegungsschrift 41 13 422 proposes an undercarriage head provided with a clamping device and with a clamping and rotating device. The clamping device has two clamping cheeks which embrace the pipe and are driven by hydraulic cylinders in order to grip the pipe fast between them and prevent it from rotating. The clamping and rotating device includes a carrier which can rotate about the axis of the pipe on which are fitted two clamping cheeks which act on the pipe and are driven by respective cylinders. A further cylinder drives a holder so as to cause it to rotate round the axis of the pipe.

The above-mentioned disadvantages are also suffered by a boring apparatus known from German patent 41 22 350, which needs so much space that it is mounted above ground and first creates a downwardly inclined pilot bore in order to reach the laying depth and then continues boring horizontally. However, such apparatus is not suitable for laying house connections, since on account of its large external dimensions it cannot be accommodated in the sidewalk region. Furthermore it is not possible even to reach the laying depth in the sidewalk region in order to connect the house connection to a main line laid along the street.

OBJECT OF THE INVENTION

Starting from this state of the art, the object of the invention is to provide an apparatus which requires little space and which permits rapid connection of a string section on the one hand to the rotary drive and on the other hand to the rearward end of a string which is already present underground.

SUMMARY OF THE INVENTION

To this end, in accordance with the invention in an apparatus of the above-mentioned kind the rotary drive is provided with a plug-in coupling comprising a chuck on the one hand and a locking portion at the end of a string or string section which can be inserted into the chuck in a simple manner without the need for screwing up. This can for example be done through a radial opening in the chuck.

The chuck avoids the need for a screw on the drive side and can include a cup pointing in the direction of the axis of rotation and open in the direction of advance, into which the rearward end of the new string section can be pushed. This cup then prevents the string section from falling out through the insertion opening during rotation. If the string section or the cup is provided with a seal it is possible for the string to be supplied with a liquid through a supply line ending in the base of the cup.

The plug-in connection can be formed in the manner of a bayonet joint and, for example, include an end collar behind which is located at least one radial stop which on rotation of the chuck connected to the drive shaft of the rotary drive in both directions acts as a driver to screw the front end of the new string section to the rearward end of a string which is already present underground. This driver preferably cooperates with a stop face in the string section.

The feed drive and the rotary drive with the plug connection are preferably mounted in a frame having a string guide, in which at least one thrust cylinder can be mounted in order to move the rotary drive with the plug connection forward by about the length of one string section. This can also be done by means of a third thrust cylinder, preferably mounted in the middle between the first and second thrust cylinders, the piston rod of which is then connected to the rotary drive. In this way a short overall length is obtained with high thrust force and relatively great string section length. Telescopic cylinders are also suitable as thrust means.

However, it is a disadvantage of such cylinders that the forces in the respective stages are different and so do not deliver continuous feed and traction forces or a continuous feed rate. To lengthen the feed path, the transfer of force from the cylinder to the rotary drive can also take place through a chain routed as in a differential pulley, thereby for example enabling the feed path to be doubled.

Instead of three separate cylinders, it is also possible to employ a cylinder block which is provided with three piston rods, one of them advancing in one direction and the other two in the opposite direction.

To provide for rapid screwing of the front end of a string section on to the rearward end of the drill string, the frame can be provided with a radially movable holding claw, which engages with at least one key face at the rearward end of the string and serves to prevent rotation during screwing up. The holding claw is preferably articulated to one end of a two-armed lever having a pivot fixed relative to the frame, which makes linear movement of the claw possible for example when the pivot pin reaches through a slot in the claw carrier.

In order to fix the apparatus in the excavation or launch pit the frame can be provided with horizontally extendable support braces through which the recoil forces can be led into the ground.

The string comprises several sections each having an internal screw thread at one end and a locking portion with an external screw thread at the other end. It is suitable not only for apparatus of the aforementioned kind but also, in combination with the complementary chuck, for other apparatus having a feed drive and optionally also a rotary drive, for example for rod and pipe extrusion apparatus.

The locking portion is preferably provided with at least one key face for non-rotatably fixing the string section as the next following string section is screwed on. The locking portion can further include a stop face, and a tubular filler body of a material of relatively low specific gravity, for example of plastics material, may be located in the interior of the string section. This filler body serves to reduce the cross-section of the opening of a tubular drill string to the appropriate size for passage of a flushing, cutting, lubricating or steering liquid, and in view of its relatively low specific gravity, to keep the total weight of the pipe length as light as possible.

BRIEF DESCRIPTION OF THE DRAWINGS

The invention will now be described in more detail, by way of example, with reference to an embodiment illustrated in the drawings, in which.

DETAILED DESCRIPTION OF A PREFERRED EMBODIMENT OF THE INVENTION

Figure 1:
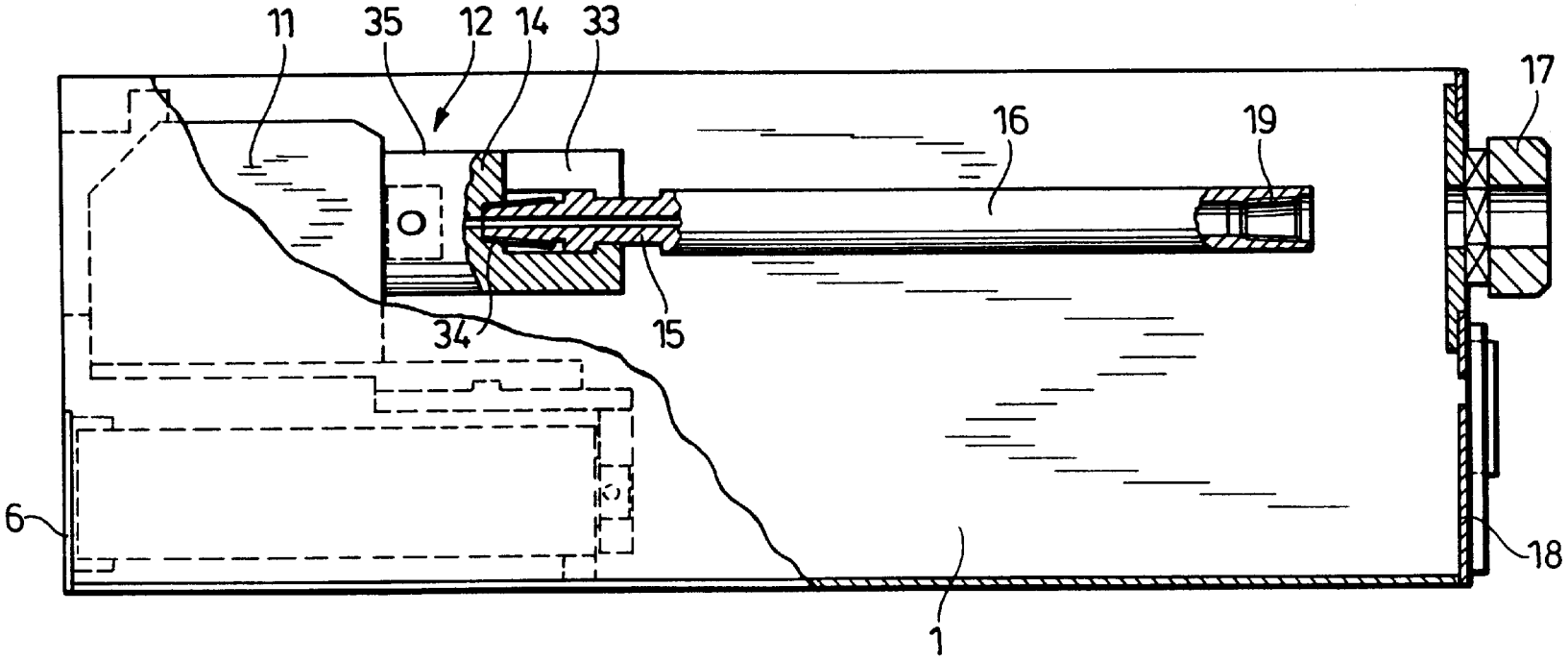
FIG. 1 is a side view of the apparatus, partly in section.
Figure 2:
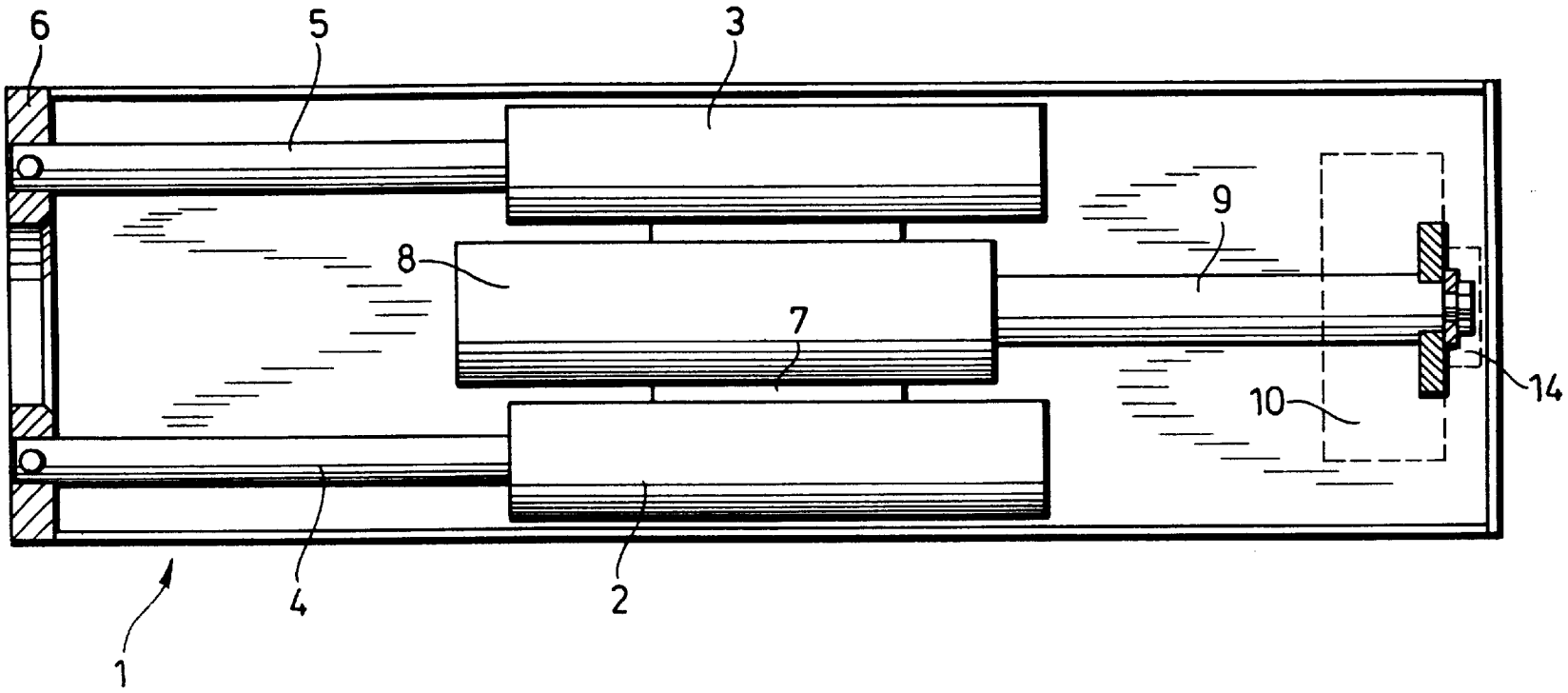
FIG. 2 is a simplified plan view of the apparatus of FIG. 1.
Figure 3:
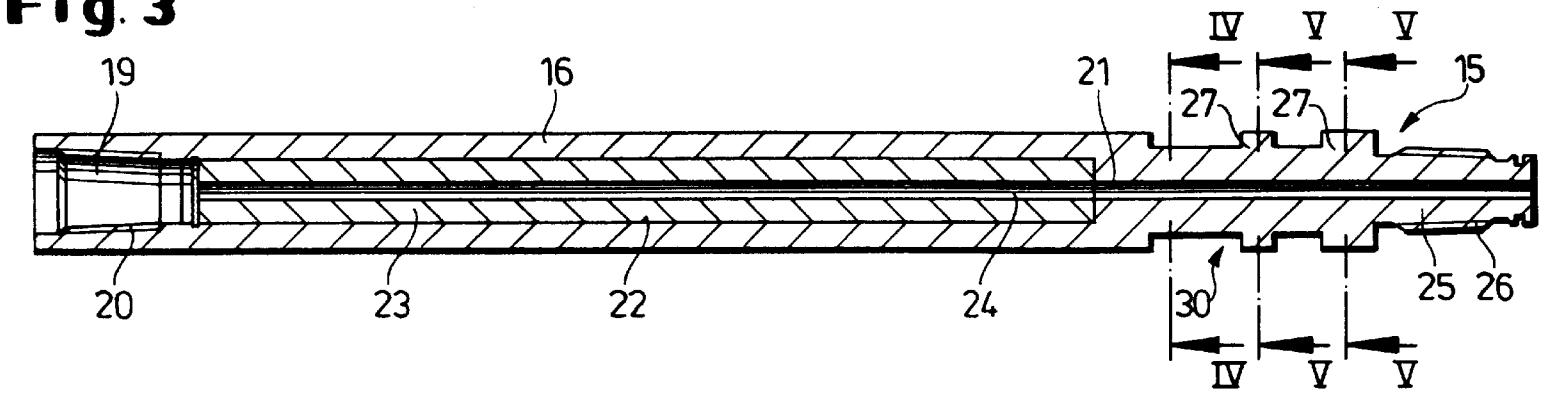
FIG. 3 is a longitudinal section through a string section.
Figure 6:
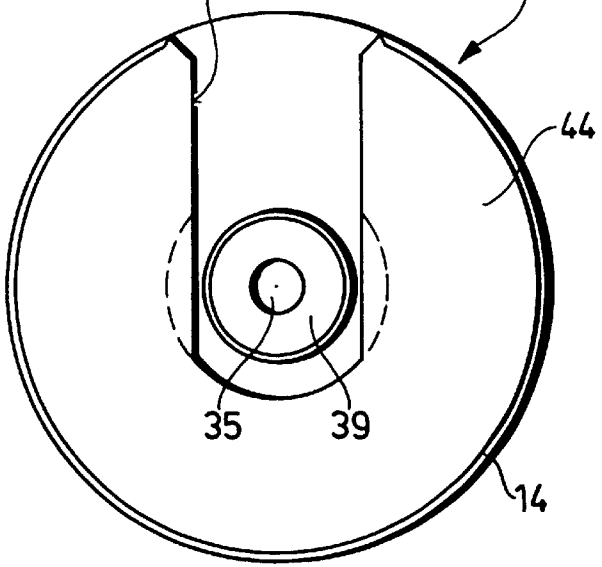
FIG. 6 is a front view of the chuck with the insertion opening.
Figure 5:
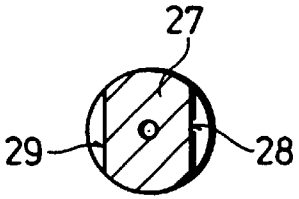
FIG. 5 is a section on the line V—V in FIG. 3.
Figure 4:
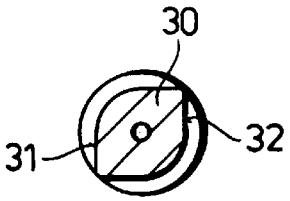
FIG. 4 is a section on the line IV—IV in FIG. 3.

The apparatus 50 illustrated comprises a box-shaped frame 1 in which two thrust cylinders 2, 3 are mounted parallel to one another on a sliding carriage (not shown) with their piston rods 4, 5 supported on the rear end wall 6 of the housing 1. The two hydraulic cylinders 2, 3 are connected rigidly together by a bar 7 on which a further cylinder 8 is mounted in the middle. The piston rod 9 of the middle cylinder 8 carries a console 10, shown only schematically, on which a rotary drive 11 is mounted.

The drive shaft (not shown) of the rotary drive 11 is non-rotatably connected to a plug connection 12 consisting of a chuck 14 and a locking portion 15 at the end of a string section 16. The string section 16 is aligned with a string guide 17 on the front end wall 18 of the frame 1 and is provided at its forward end with a slightly conical screw coupling 19 having an internal screw thread 20, which can be screwed on to the rearward end of a preceding first section, for example having a drilling tool and/or a steering face and/or a device for locating the tip of the string or of a string (not shown) which is already present underground. If, for example, the string is used as a towed string, corresponding threaded portions of reaming or expanding tools can of course also be screwed into the internal thread.

The string section 16 has a stepped bore 21, 22, in the larger section 22 of which there is a tubular filler body 23 the longitudinal bore 24 of which has substantially the same cross-section as the bore 21. This filler body serves to reduce the weight of the string section 16 and the clear width of the bore section 21.

The rearward end of the string section 16 opposite the screw coupling 19 comprises a front section 25 having an external screw thread 26 which corresponds to the internal thread 20 at the other end of the string section and serves to screw two similar string sections together. Next to the front section 25 are two similar stops, each having two stop faces 28, 29, and a further section 30 having two key faces 31, 32 on opposite sides thereof. The key faces have rounded-off lower edges which facilitate engagement and by rotation of the string section in the chuck 14 make axial locking to the chuck possible. The locking portion comprising the two sections 26, 30 and the two stops 27 can be put into the chuck 14 from above through a radial slot 33 so that on axial displacement of the string section 16 its rearward end 25 partly engages in a cup 34 having a supply line 35 for a flushing, lubricating, cutting and steering liquid. The rotary drive 11 is connected to a limit switch (not shown) which ensures that when the chuck 14 is at rest the insertion slot 33 always points upwards.

The cup prevents the string section 16 or its locking portion 15 from falling out of the radial slot 33 when the chuck 14 is rotated. On such rotation at least one of the two stop faces 28, 29 of the stops 27 meets one of two corresponding stop faces (not shown in the drawings) in the interior of the chuck 14, which act as drivers for the string section 16, so that its internal thread 20 can be screwed on to the outer thread 26 or the rearward end of a string already present in the ground which is shaped like the threaded section 25.

Figure 7:
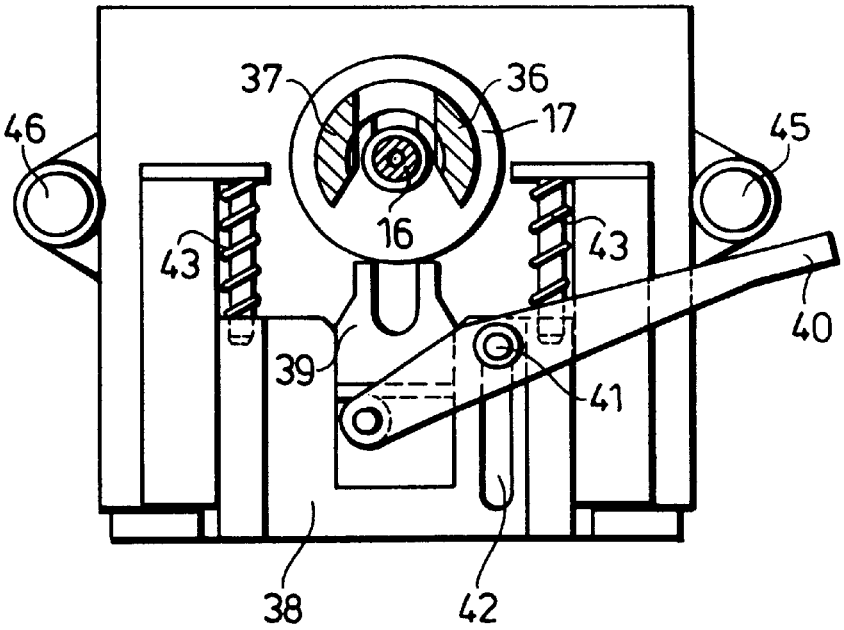
FIG. 7 is a front view of the apparatus shown in FIGS. 1 and 2 with rotation prevention means in its rest position and FIG. 8 is the front view of FIG. 6 with the rotation prevention means in its operating position.
Figure 8:
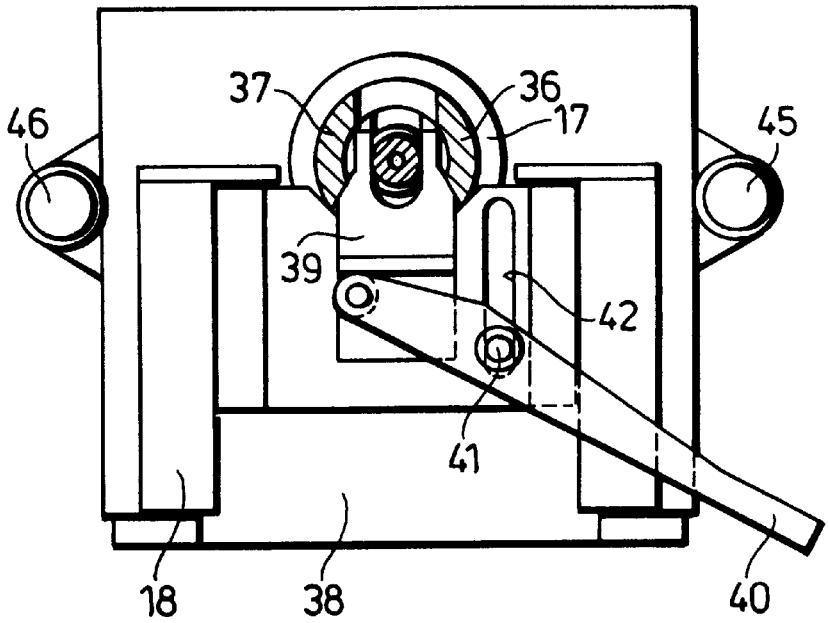
Figure 9:
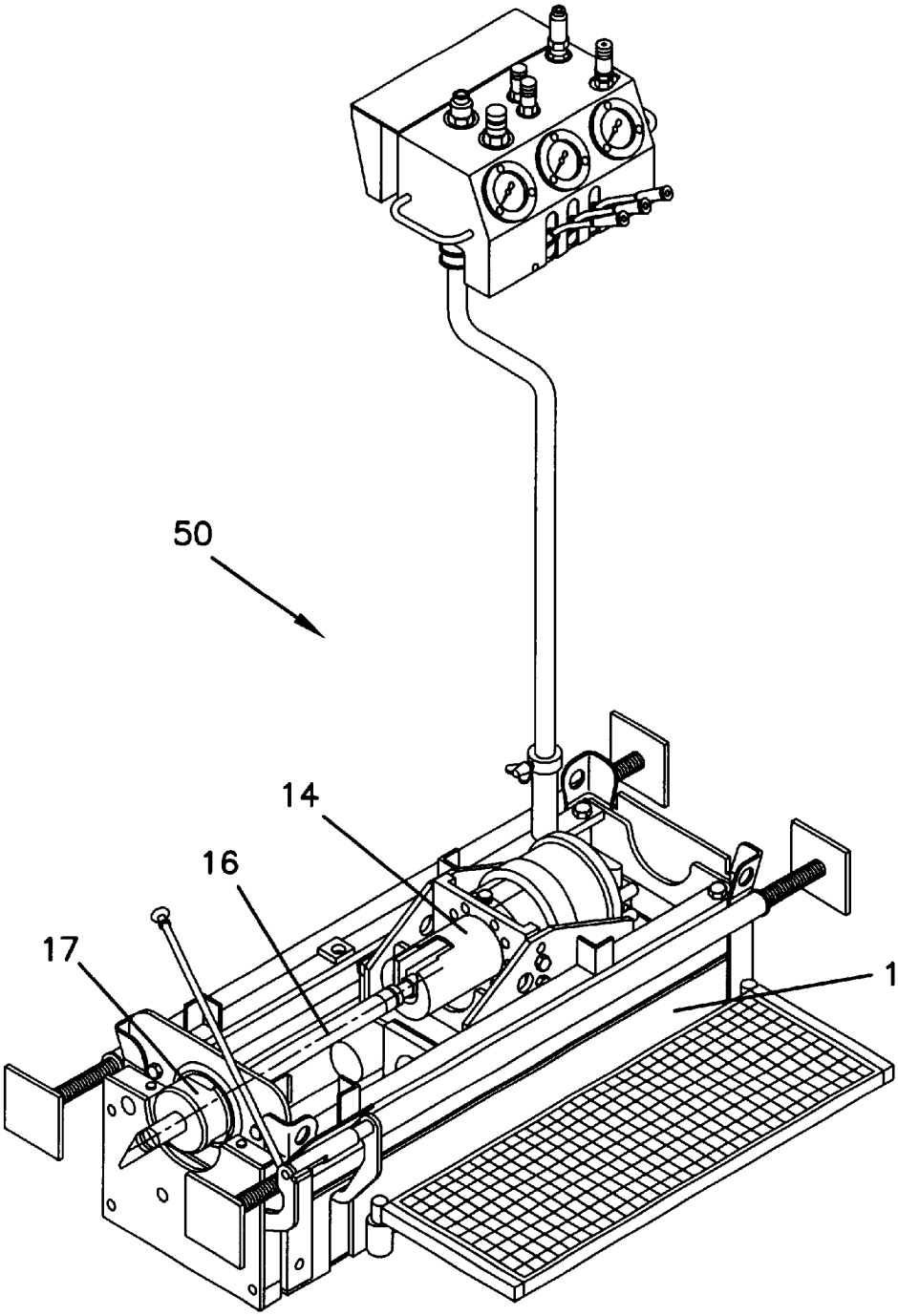
FIG. 9 is a perspective view of the apparatus.

On the front end wall 18 of the frame 1, below the string guide 17 with two guide cheeks 36, 37, there is a sliding member 38 which is radially movable relative to the string and has a holding claw 39. This holding claw is articulated to a two-armed hand or foot lever 40 of which the pivot pin 41 is guided in a vertical slot 42 in the sliding member 38 which is acted on by two return springs 43 fixed to the frame. These return springs move the sliding member 38 with the holding claw 39 into the rest position shown in FIG. 7, from which the holding claw 39 can be moved into the operating position shown in FIG. 8 by means of the hand or foot lever 40. In this position the section 30 with its two key faces 31, 32 is located in the U-shaped opening of the holding claw 39, so that the string section 16, and with it the string present in the ground in front of the end wall 18, is secured against rotation and the thread 20 at the front end of the next string section can be screwed on to its threaded section 25, or a string section can be unscrewed therefrom.

The stop 27 adjacent to the section 25 is not absolutely necessary, nor does it need to have the same form as the other stop 27. Its purpose is to fix the string in the axial direction by cooperation with the claw 39. This is primarily required when the string is present in relatively loose ground and there is a risk that the chuck may strike the rearward end of the string or of the last string section as it moves forward. Depending on the force of impact, the string may then unintentionally move some distance into the ground and coupling with the chuck may only be possible with difficulty or not at all. If the holding claw engages the section 30, the string section in question is then secured against rotation and the two shoulders to the left and right of the section 30 limit the axial movement in both directions.

Using the plug connection in accordance with the invention a new string section can very quickly be attached with little construction cost and little need for space to a preceding string section or to the rearward end of a string already present in the ground. For this purpose all that is needed is for the locking portion 15 to be placed loosely in the chuck 14 and to be moved axially a little way towards the rotary drive, until the rearward end of the string section engages in the cup 34. The chuck 14 is then rotated by means of the rotary drive and at the same time the rotary drive is moved forward by means of the thrust cylinders 2, 3, 8. In the course of a quarter turn of the chuck 14 the middle section 27 of the pipe length 16 arrives behind an end collar 44 and the internal thread 20 is screwed on to the external thread 26 at the end of a drill string which is secured against rotation by means of the holding claw 39. As soon as the two pipe sections have been screwed together the sliding member 37 is moved downwards together with the holding claw 39, and the drill string, including the new string section which has been added, is set in rotation.

By means of supporting braces 45, 46 located at the sides of the frame 1 the frame is braced securely in a launch pit.

The apparatus in accordance with the invention is so designed that it cannot only be used in a pit. Rather, it is also suitable for mounting on a pivoting undercarriage, which allows it to be used to make an above-ground sloping borehole. Here the compact construction is not so important. However, the particular advantages of the quick coupling in accordance with the invention of the driven chuck on the one hand and the locking portion at the end of the string section on the other hand are retained. The apparatus in accordance with the invention is therefore suitable for all kinds of earth working using a rotating string, particularly for producing and expanding earth boreholes by drawing or pressing, for destroying, replacing and introducing pipelines by pressing, hammering and/or traction. The insertion can be done by pressing, drawing and impact.

What is claimed is:

1. Apparatus for producing and expanding earth boreholes and for destroying and replacing lines laid underground, comprising a feed drive adapted to drive a string comprising at least one string section, a rotary drive adapted to drive the string, and a plug-in coupling connecting the feed drive and the rotary drive with the string, the coupling comprising a chuck defining a radial opening shaped to receive a locking portion at an end of the at least one string section, whereby the chuck is adapted to engage the locking portion when the locking portion is radially inserted into the radial opening.

2. Apparatus as claimed in claim 1, wherein the chuck comprises a cup pointing in the direction of the axis of rotation.

3. Apparatus as claimed in claim 2, further comprising a liquid supply line that opens into the cup, and wherein and the at least one string section comprises a length of pipe.

4. Apparatus as claimed in claim 1, wherein the chuck comprises a slotted front end collar and at least one radial stop.

5. Apparatus as claimed in claim 1, wherein the chuck comprises at least one axial stop.

6. Apparatus as claimed in claim 1, further comprising a frame having a string guide.

7. Apparatus as claimed in claim 6, further comprising at least two feed cylinders located in the frame.

8. Apparatus as claimed in claim 6, wherein the frame comprises a radially moveable holding claw.

9. Apparatus as claimed in claim 8 wherein the holding claw is articulated to a two-armed lever through a sliding member.

10. Apparatus as claimed in claim 9 further comprising return springs adapted to engage with the sliding member.

11. Apparatus as claimed in claim 6, wherein the frame comprises horizontally extendable bracing supports.

12. Apparatus as claimed in claim 1, wherein the string comprises a plurality of string sections, and wherein the string sections are connected to one another by a screw thread.

13. A string adapted to be connected to an apparatus for producing and expanding earth boreholes and for destroying and replacing lines laid underground, said string comprising at least one section, said at least one section having an internal screw thread at a first end and a locking portion having an external screw thread at a second end, wherein the locking portion is provided with key faces that run arcuately between opposite edges.

14. A string as claimed in claim 13, wherein the locking portion comprises at least one axial stop.

15. A string as claimed in claim 13, wherein each at least one string section defines a longitudinal bore and a tubular filler body is disposed therein.

16. A string as claimed in claim 13, wherein the locking portion comprises at least one radial stop.

17. A method for inserting in the ground drill strings for producing and expanding earth boreholes and for destroying and replacing underground lines using a rotary drive, the method comprising radially inserting a locking portion at an end of a string section into a chuck in engagement with a rotary drive, the chuck defining a radial opening shaped to receive the locking portion, whereby the chuck engages the locking portion so as to form a plug-in coupling, and screwing the string section onto a string present in the ground by means of the rotary drive.

18. A method for inserting in the ground drill strings for producing and expanding earth boreholes and for destroying and replacing underground lines using a rotary drive, the method comprising unscrewing a string section from a string present in the ground by means of a rotary drive, and disengaging a plug-in coupling comprising a chuck by radially removing a locking portion at an end of the string section from a radial opening in the chuck, the chuck being in engagement with the rotary drive.

* * * * *